United States Patent [19]

Kaganas

[11] 4,383,712

[45] May 17, 1983

[54] COMPOSITE SEAT COVER

[75] Inventor: Jose Kaganas, Miami, Fla.

[73] Assignee: Sheepskin Autoseat Corporation, Hialeah, Fla.

[21] Appl. No.: 375,332

[22] Filed: May 5, 1982

[51] Int. Cl.[3] ..... A47C 31/10

[52] U.S. Cl. ..... 297/219; 297/453

[58] Field of Search ..... 297/229, 219–228, 297/453

[56] References Cited

U.S. PATENT DOCUMENTS

| | | | |
|---|---|---|---|
| 1,967,904 | 7/1933 | Sallop | 297/223 |
| 2,027,947 | 1/1936 | Wittcoff | 297/219 |
| 2,223,861 | 12/1940 | Wagner | 297/453 X |
| 2,791,268 | 5/1957 | Mendelsohn | 297/229 |
| 3,226,157 | 12/1965 | Reinfeldt et al. | 297/219 |
| 3,278,226 | 10/1966 | Magnusson | 297/219 |

FOREIGN PATENT DOCUMENTS

| | | | |
|---|---|---|---|
| 2516528 | 10/1976 | Fed. Rep. of Germany | 297/219 |

*Primary Examiner*—Francis K. Zugel

*Attorney, Agent, or Firm*—Kirschstein, Kirschstein, Ottinger & Cobrin

[57] ABSTRACT

A composite seat cover includes a covering element which has two opposite major surfaces one of which faces away from the seat in use. This surface is provided with a plurality of regions which may be provided on separate members affixed to one another, such as by sewn seams, to constitute the covering element. At least two sets of such regions are provided, one such set having relatively long and the other relatively short hair-like elements at the one major surface which form alternating patches. Because of the alternating of the long-haired and short-haired patches, the seat user will be able to occupy the seat covered by such a seat cover for extended stretches without feeling discomfort. The seat cover can also include a backing consisting of a foam padding and a backing consisting of a foam padding and a backing sheet. The seat cover can be secured to the seat by a strap of a variable length, or by a plurality of such straps. The covering portion is preferably of sheepskin and may include two sections one of which covers the seat portion and the other the backrest portion of the seat, such as a car seat.

21 Claims, 4 Drawing Figures

COMPOSITE SEAT COVER

BACKGROUND OF THE INVENTION

The present invention relates to seat covers in general, and more particularly to a seat cover which is especially suited for use on car seats, such as bucket seats, or the like.

Experience with conventional seats, especially with car seats, has shown that, if a person has to sit on them for extended periods of time without being able to get up from time to time, sitting on such seats brings a certain degree of discomfort to such a person. Many attempts have previously been made to make seats more comfortable than before, by profiling the seats, providing them with paddings of different consistencies and shapes, by selecting the materials of the upholstery and, last but not least, by designing various covers or cushions or similar buffers which can be placed on the seat and even customized to the particular person. Various approaches to making seats, especially car seats, comfortable to the users thereof are shown, for instance, in the U.S. Pat. Nos. 3,093,407, 3,099,483, 3,819,232, 4,019,776, and 4,108,776.

However, no matter how the problem of long-time discomfort is approached in the conventional solutions, the end result in each instance is only minimization of the discomfort, that is, extension of the time period during which the user of the seat will not be unduly burdened while using the seat. Once the seat and/or the cover, cushion or other bolster is properly shaped, the main cause of the discomfort is avoided. However, there remain several other causes which cannot be removed by changing the shape and/or the softness of the seat or bolster. So, for instance, prolonged sitting on a seat interferes with the circulation of blood through the tissues of the body of the user which are proximate to the seat; the temperature of such tissues may rise because of lack of circulation of air around the skin at their region; and the sensitivity of such tissues may be affected due to the pressure applied thereto.

The problem of lack of air circulation around the skin can be alleviated by making the seat permeable to air and/or by providing the same with passages for the air, such as by quilting. However, these approaches usually not only do not deal with the other above-mentioned problems, but even aggravate the same, especially since they result in an unequal distribution of the body weight of the seat user over the area of juxtaposition with the seat.

It is also already known to use various materials for seats themselves or for seat covers, cushions or the like. Such conventionally used materials may include various fabrics, natural or imitation animal skins, hides or furs, or vinyl or similar synthetic plastic materials. While each of such materials has its advantages, no ideal use for them has been yet found in the field of manufacturing seats or seat covers, which would deal with all sources of discomfort to the seat user.

Another problem encountered in connection with seat covers is that the user may either stick to the cover or slip on it, depending on the material of the cover and the way the user is dressed, especially when moisture, such as perspiration, is permitted to reach the seat cover. Of course, such a problem also exists when no seat cover is used, this time in connection with the seat proper. This, of course, is also very disadvantageous, especially since the body of the user may be either hampered in performing movements desired by the user, or permitted to conduct movements undesired by the user. This problem is not efficiently avoided by any heretofore known seat upholstery or seat cover materials or structures.

SUMMARY OF THE INVENTION

Accordingly, it is a general object of the present invention to avoid the disadvantages of the prior art.

More particularly, it is an object of the present invention to provide a seat cover, particularly but not exclusively suited for use on car seats, which does not possess the disadvantages of the conventional seat covers of this type.

Still another object of the invention is so to construct the seat cover as to alleviate the problems mentioned before which could make the user of the seat to feel uncomfortable after only a short period of sitting on the seat cover.

It is yet another object of the present invention so to design the seat cover as to enhance blood circulation through and air circulation past the portions of the body of the seat user which are juxtaposed with the seat cover.

A concomitant object of the present invention is to develop a seat cover which is easy to manufacture, relatively inexpensive, which can be installed in a simple manner, but which is very comfortable and reliable nevertheless.

An additional object of the present invention is to devise a seat cover of the type here under consideration which can be fitted to seats of various configurations and dimensions and which eliminates the problem of undesirable influence of the seat proper or of the seat cover on the user's control of body movements.

In pursuance of these objects and others which will become apparent hereafter, one feature of the present invention resides in a composite seat cover which comprises at least one covering portion of a sheet-like configuration having a first and and a second major surface respectively facing away from and toward the seat in use, the first major surface having at least two sets of regions which so adjoin each other that the respective region of one of the sets adjoins at least one region of the other set, at least the regions of the one set having a multitude of hair-shaped elements projecting therefrom, the hair-shaped elements of the one set of regions having lengths which at least on the average exceed those of any hair-shaped elongated elements of all other regions.

The above-discussed composition of the seat cover results in several advantages. So, for instance, the presence of the hair-shaped elements of the longest average length on some but not all of the regions of the first major surface of the covering portion results in an improved access of the ambient air to the parts of the skin of the user which are juxtaposed with the covering portion, so that the danger of excessive warming-up and perspiration at such skin parts is reduced. Moreover, the blood circulation of such skin parts and other tissues of the user is dramatically improved, which is attributable not only to the presence of the fibrous or hair-like elements, but also to the difference between the lengths of the fibrous elements of the various regions of the first major surface. Another advantage is that the fibrous elements to a certain degree massage the juxtaposed skin parts, usually through articles of clothing, which stimulates the blood flow and improves the sensitivity of the skin. The covering portion of this composition will not stick to the body of the user or to any articles of clothing worn by such a user; on the other hand, the hair-like elements will reduce if not eliminate the danger of slippage on the cover, so that the user can rest assured that the cover will not interfere with his or her intended movements. However, even relatively slight shifts of the user on the cover, which can easily be made despite the fibrous character of at least some of the regions of the first major surface and the unintended movement retarding action thereof, will juxtapose the various parts of the skin of the user with regions of the first major surface which have a different texture from those regions with which such skin parts were juxtaposed prior to the shifting, so that long-term fatigue of such skin parts is avoided.

A particularly advantageous composition of the covering portion in accordance with the present invention is obtained when the other set of the regions of the first major surface also has the hair-like elongated elements, but when the lengths of such elements are at least on the average shorter than those of the hair-like elements of the regions of the one set. In this structure, the advantages discussed above are retained, but the air circulation and the anti-slippage action are further improved.

When only two sets of the aforementioned regions are provided, it is advantageous when the regions of the one set alternate with the regions of the other set. In this context, it is especially advantageous when the covering portion is substantially rectangular, and the aforementioned regions are also substantially rectangular. So, for instance, the covering portion can be square or longer in one direction than in the other, and the above regions may be square or strip-shaped. In either event, the border zones of the regions at which the different regions adjoin one another may advantageously be substantially parallel to the marginal zones of the covering portion. When the regions are, as mentioned above, substantially strip-shaped, it is further advantageous when they are substantially coextensive with two opposite ones of the marginal zones of the covering portion. Then, it may be further advantageous to so arrange the strip-shaped regions that they are substantially normal to the lateral marginal zones of the covering portion as considered in the position of use, so that they extend substantially transversely of the seat, rather than in the front-to-rear direction.

The above-discussed regions may be constituted by parts of a unitary or one-piece covering portion which differ from one another only in the lengths of their respective hair-shaped or hair-like elements. This can be achieved, for instance, by shearing the elements of the above-mentioned regions of the other set and leaving the elements of the one set intact or shearing them to longer lengths. However, it is further advantageous, in accordance with a further aspect of the present invention, to make the covering element of separate members each of which carries one of the regions and which are connected with one another by appropriate connecting means, especially by respective seams. Then, it is especially advantageous when the separate members of at least one of the sets are of an animal skin, particularly sheepskin. Experience has shown that sheepskin is a material which is particularly advantageous for this use, since it keeps the body warm at low ambient temperatures, while keeping the juxtaposed portions of the body of the user relatively cool at high ambient temperatures, especially by permitting air circulation. As a matter of fact, it is very advantageous when the entire covering portion consists of animal skin, especially sheepskin, for much of the same reasons and also because of the material compatibility during the manufacture and use of the covering portion.

The covering portion and the cover itself as described so far could be, in accordance with the present invention, a permanent part of the seat or a separate component which is merely placed on a seat which is upholstered or bare but usable without such a cover. In the second case, it is further advantageous when, in accordance with a further facet of the present invention, the cover further includes a lining portion, especially of a padding material, such as a material of a foamy consistency, this lining portion being arranged at the second major surface of the covering portion and the covering portion being so attached to the lining portion as to form a cushion therewith. Moreover, there may further be provided means for securing the covering portion to the seat, whether or not the covering portion is attached to the lining portion or whether or not the lining portion is provided at all. The securing means may advantageously include at least one strap connected to the covering portion and extending around the seat in use.

While a large series of the seat covers can be manufactured for use on a series of seats of the same design and dimensions, should the demand warrant it, it is more advantageous to make the seat cover of the above-discussed type adaptable to various types of seats of dimensions which vary from one seat type to another. Since, in most instances, the seating area dimensions vary only negligibly and the biggest dimension differences are encountered outside the sitting area, it is further advantageous when, in accordance with a further concept of the present invention, it is provided for adjustment of the strap to seats of different types and dimensions. This may be achieved, for instance, by making the securing strap elastically extendable, so that it can be used for securing the covering portion to seats whose dimensions vary in a relatively wide range. This possibility is contemplated by the present invention. However, the range of dimensions of the seats on which the covering portion or the cover can be used can further be expanded by making the strap adjustable as to its effective length. This can be achieved in a simple manner when the strap is constructed, in accordance with the present invention, in such a manner that it includes two sections each of which is separately connected to the covering portion or cover at one of its ends, and that the means for adjusting the effective length of the strap includes a buckle affixed to one of the strap sections at the free end thereof and engaging the other strap section along its length in use.

When the cover is to be used on a seat, such as a car seat, which has a seat portion and a backrest portion, it is particularly advantageous when, in accordance with the present invention, the covering portion has at least two sections one of which covers the seat portion and the other of which covers the backrest portion of the seat in use.

The novel features which are considered as characteristic of the invention are set forth in particular in the appended claims. The improved seat cover itself, however, both as to its structure and its mode of application, together with additional features and advantages thereof, will be best understood upon perusal of the following detailed description of certain specific embodiments with reference to the accompanying drawing.

DETAILED DESCRIPTION OF THE PREFERRED EMBODIMENT

Figure 1:
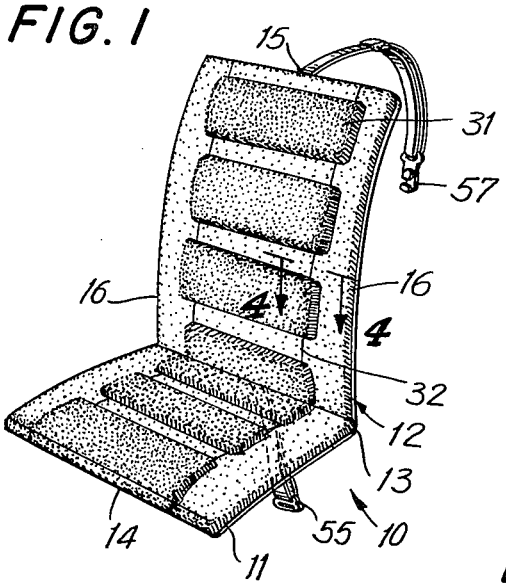
FIG. 1 is a perspective view of the seat cover of the present invention as constructed for use on a seat having a seat portion and a backrest portion.
Figure 2:
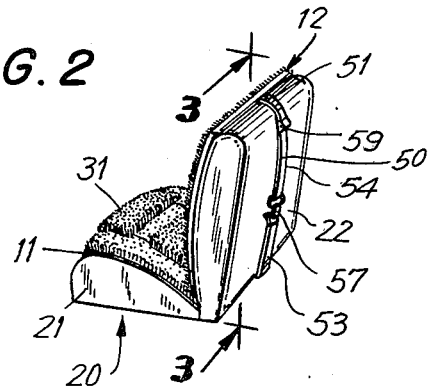
FIG. 2 is a rear perspective view of a seat having the seat cover of FIG. 1 secured thereto.

Referring now to the drawing in detail, and first to FIG. 1 thereof, it may be seen that the reference numeral 10 has been used to identify a seat cover of the present invention in its entirety. As illustrated, the seat cover 10 is constructed as a separate component which may but need not be of a self-supporting construction and which is intended to be placed onto a seat, such as a car seat 20 shown in FIGS. 2 and 3, which has a seat portion 21 and a backrest portion 22. However, it will become clear as the description proceeds that the seat cover 10 is also suited for use on seats other than car seats or even on seats which do not have backrests.

Figure 3:
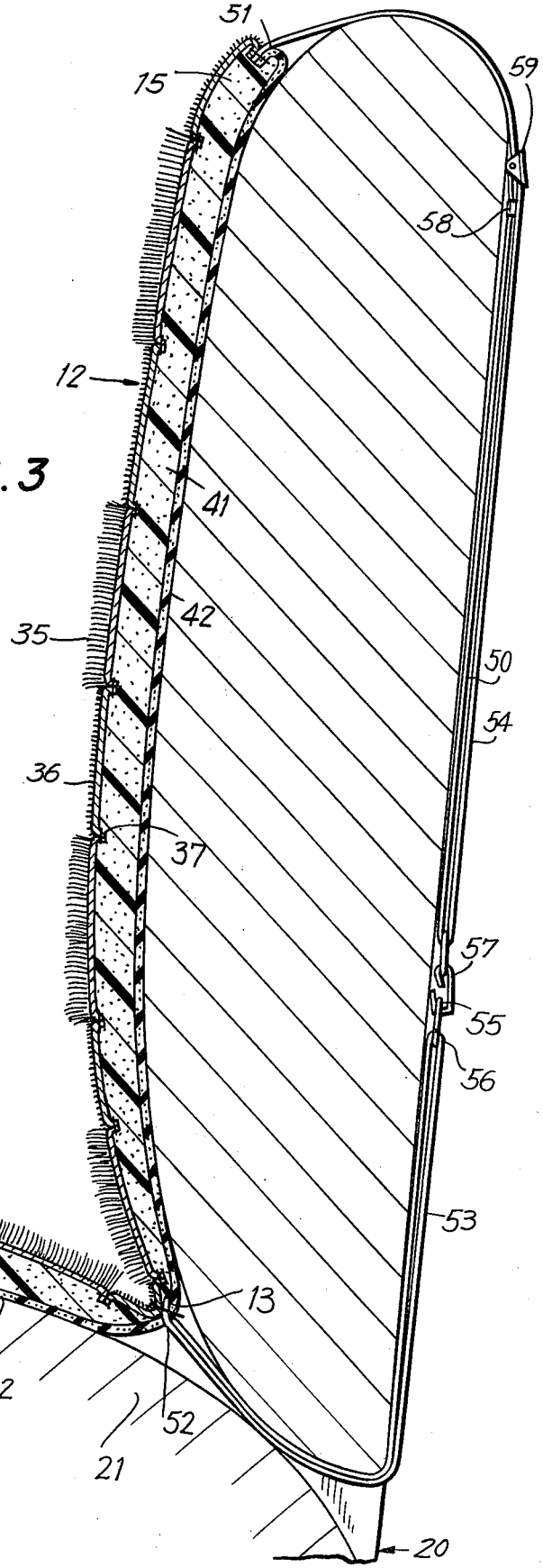
FIG. 3 is an enlarged sectional view of the seat with the seat cover taken on line 3—3 of FIG. 2.
Figure 3:
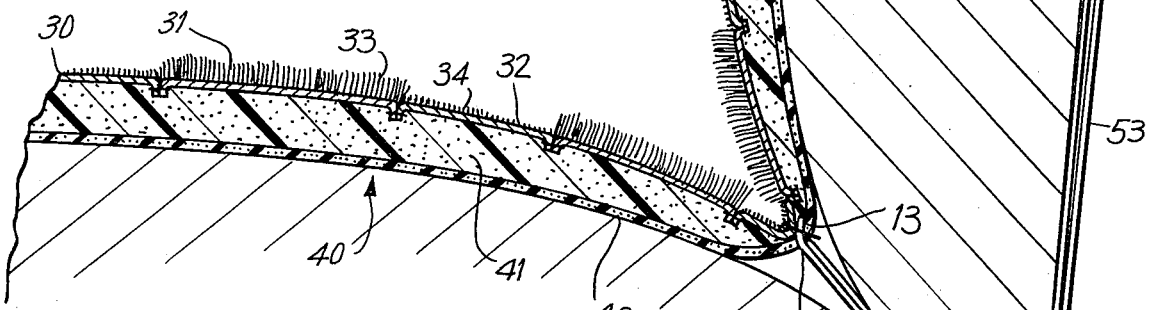

As may be seen in detail in FIGS. 1 and 3, the illustrated seat cover 10 has a seat section 11 and a backrest section 12 which merge with one another at a corner zone 13. The seat section 11 has a front marginal zone 14 parallel to and spaced from the corner zone 13, and the backrest portion has an upper marginal zone 15 which is also parallel to and spaced from the corner zone 13. Thus, if developed into a plane, the seat cover 10 has a rectangular configuration, wherein the marginal zones 14 and 15 constitute the shorter sides of the rectangle. The longer sides of this rectangle are constituted by respective lateral marginal zones 16 which extend from the upper marginal zone 15 downwardly to the corner zone 13 and from there frontwardly to the front marginal zone 14 as considered in the position of use of the seat cover 10.

As shown in FIG. 3, the seat cover 10 includes a covering portion 30 which has a first surface facing away from and a second surface facing toward the seat 20 in use. The first surface is provided with at least two sets of regions 31 and 32 which have different textures. As illustrated, the regions 31 are provided with relatively long hair-shaped elements, while the regions 32 are provided with relatively short hair-shaped elements, such elements being indicated by reference numerals 33 and 34, respectively.

Figure 4:
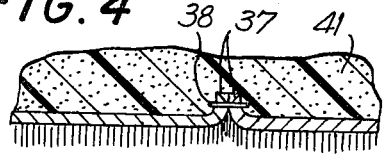
FIG. 4 is an additionally enlarged sectional view taken on line 4—4 of FIG. 1.

The regions 31 and 32 are shown to be respectively provided on separate members 35 and 36 which have rectangular configurations and are delimited by respective border zones 37. As shown especially in FIG. 4, the border zones 37 of the respective immediately adjacent separate members 35 and 36 are joined with one another by stitches 38 to form respective seams. It is to be noted that the separate members 35 and 36 alternate with one another, so that the regions 31 and 32 alternate with one another in an identical fashion. It may be seen particularly in FIG. 1 that the regions 31 and 32 are substantially rectangular and strip-shaped and that they extend substantially parallel to and coextensively with the front and upper marginal and with the corner zones 14, 15 and 13. However, it is to be understood that the regions 31 and 32 and/or the separate members 35 and 36 could also have different orientations and/or different polygonal or other configuration without departing from the gist of the present invention. What is important in this context is that the different regions, such as 31 and 32, having differently long hair-shaped or hair-like elements, such as 33 and 34, are distributed over the first surface of the covering portion 30 of the seat cover 10 in the form of patches.

The illustrated seat cover 10 also includes a backing or lining 40 for the covering portion 30. The backing 40 is shown to be permanently attached to the covering portion 30 and to include a foam material padding 41 and a backing sheet 42 which confines the padding 41 between itself and the covering portion 30. This is shown in detail in FIG. 3.

The seat cover 10 advantageously should be secured to the seat 20. For this purpose, it is equipped with a strap 50 at least for the backrest section 12. This strap 50 is shown to have one end portion 51 which is affixed to the upper marginal zone 15 of the seat cover 10, and another end portion 52 which is affixed to the corner zone 13 of the seat cover 10. To be able to use the same cover 10 and the same strap 50 with a variety of seats of different constructions and dimensions, the strap 50 is adjustable as to its length. This can be simply achieved by making the strap 50 of an elastic material. However, it is also possible and contemplated by the present invention, instead or in addition to making the strap 50 elastic, to make the same, as shown especially in FIG. 3, of two sections 53 and 54 which are respectively individually attached to the zones 15 and 13 of the seat cover 10 at their ends 51 and 52. Then a buckle 55 is mounted on a free end portion 56 of the strap section 53 and engages the strap section 54 along its length. In the illustrated construction, the buckle 55 engages a bracket 57 which is mounted on the strap section 54 between the end 51 and a free end 58. The free end 58 is clamped to a zone of the strap section 54 by a clamping component 59 which is of a well-known construction so that it need not be discussed here in any detail. Suffice it to say that the clamping component 59 can be disengaged from the above-mentioned zone of the strap section 54, but usually not from the free end 58 thereof, and shifted longitudinally of the strap section 54, whereby the effective length of the latter is adjusted.

It will be appreciated that the positions of the buckle 55 and of the bracket 57 can be reversed and also that the seat section 11 can be provided with its own strap, if so desired or if necessary. Also, more than a single strap 50 may be provided for the backrest section 12 and/or for the seat section 11, and it may extend transversely of the seat 20 as well if warranted by the circumstances.

The covering portion 30 is advantageously made of animal skin or hide, especially of sheepskin which has a very pleasant texture and other advantageous properties which make the same very comfortable even after a prolonged period of use of the seat cover 10 and of the seat 20, so that the occupant of the seat 20 covered by the cover 10 can use the seat 20 for a long stretch of time without feeling appreciable discomfort. The reasons for this pleasant feeling were discussed at length before. Suffice it to say at this juncture that the alternation of the patches of longer and shorter hair 33, 34 avoids the causes of discomfort encountered in conventional seat or seat cover constructions.

It will be understood that each of the elements described above, or two or more together, may also find a useful application in other types of arrangements differing from the type described above.

While the invention has been illustrated and described as embodied in a seat cover for a car seat, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed as new and desired to be protected by Letters Patent is set forth in the appended claims.

1. A composite seat cover, comprising at least one covering portion of a sheet-like configuration having a first and a second major surface respectively facing away from and toward the seat in use, said first major surface having at least two sets of regions which adjoin each other so that the respective region of one of the sets adjoins at least one region of another set, said regions of said one set and said other set each having a multitude of hair-shaped elongated elements projecting therefrom, said hair-shaped elongated elements of said one set of regions having lengths which at least on the average exceed those of any hair-shaped elongated elements of all other of said regions, said hair-shaped elongated elements of said other set of regions having lengths which at least on the average are shorter than those of said hair-shaped elements of said one set.

2. The composite seat cover as defined in claim 1, wherein said regions of said two sets alternate with one another.

3. The composite seat cover as defined in claim 2, wherein said covering portion is substantially rectangular; and wherein said regions are also substantially rectangular.

4. The composite seat cover as defined in claim 3, wherein said covering portion has marginal zones delimiting the same; and wherein said regions have border zones which delimit the respective regions and are substantially parallel to said marginal zones.

5. The composite seat cover as defined in claim 4, wherein said regions are substantially strip-shaped and substantially coextensive with two opposite ones of said marginal zones.

6. The composite seat cover as defined in claim 5, wherein the remaining two of said marginal zones are the lateral marginal zones as considered in the position of use.

7. The composite seat cover as defined in claim 1, wherein said regions are separate members; and further comprising means for connecting said separate members to one another.

8. The composite seat cover as defined in claim 7, wherein said connecting means includes respective seams.

9. The composite seat cover as defined in claim 8, wherein said separate members of at least one of said sets are of an animal skin.

10. The composite seat cover as defined in claim 9, wherein said animal skin is sheepskin.

11. The composite seat cover as defined in claim 1, wherein said covering portion is of an animal skin.

12. The composite seat cover as defined in claim 11, wherein said animal skin is sheepskin.

13. The composite seat cover as defined in claim 1, and further comprising a lining portion arranged at said second major surface of said covering portion, and means for so attaching said covering portion to said lining portion as to form a cushion therewith.

14. The composite seat cover as defined in claim 13, wherein said lining portion is of a padding material.

15. The composite seat cover as defined in claim 14, wherein said padding material has a foamy consistency.

16. The composite seat cover as defined in claim 1, and further comprising means for securing said covering portion to the seat.

17. The composite seat cover as defined in claim 16, wherein said securing means includes at least one strap connected to said covering portion and extending around the seat in use.

18. The composite seat cover as defined in claim 17, wherein said strap is of an elastically extendable material.

19. The composite seat cover as defined in claim 17, wherein said securing means further includes means for adjusting the length of said strap to fit the same to the respective seat.

20. The composite seat cover as defined in claim 19, wherein said strap includes two sections each separately connected to said covering portion at one of its ends; and wherein said adjusting means includes a buckle affixed to one of said strap sections at the free end thereof and engaging the other strap section along its length in use.

21. The composite seat cover as defined in claim 1 for use on a seat having a seat portion and a backrest portion, wherein said covering portion has at least two sections one covering said seat portion and the other said backrest portion in use.

* * * * *